US007360384B1

(12) United States Patent
Ghiran et al.

(10) Patent No.: US 7,360,384 B1
(45) Date of Patent: Apr. 22, 2008

(54) APPARATUS AND METHOD FOR HYDROSHEARING AND HYDROTRIMMING FOR HYDROFORMING DIE

(75) Inventors: Mike M. Ghiran, Lake Orion, MI (US); Paul D. Larsen, Fenton, MI (US); David R. Jensen, Swartz Creek, MI (US); Gerry A. Harmon, Clawson, MI (US); Sanjay M. Shah, Troy, MI (US); Terry A. Kent, East China, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/690,264

(22) Filed: Mar. 23, 2007

(51) Int. Cl.
*B21D 26/02* (2006.01)
*B21D 28/18* (2006.01)

(52) U.S. Cl. ..... 72/55; 72/58; 72/62

(58) Field of Classification Search ..... 72/54, 72/55, 56, 58, 61, 62
See application file for complete search history.

(56) References Cited

U.S. PATENT DOCUMENTS

| | | | | |
|---|---|---|---|---|
| 5,398,533 | A * | 3/1995 | Shimanovski et al. | 83/53 |
| 5,941,112 | A | 8/1999 | Ghiran et al. | |
| 5,996,455 | A * | 12/1999 | Haag et al. | 72/55 |
| 6,260,393 | B1 * | 7/2001 | Engel et al. | 72/55 |
| 6,401,507 | B1 * | 6/2002 | Krcek et al. | 72/56 |
| 6,497,128 | B1 | 12/2002 | Canfield et al. | |
| 6,672,120 | B1 * | 1/2004 | Ghiran et al. | 72/55 |
| 7,104,099 | B1 * | 9/2006 | Ghiran et al. | 72/370.26 |
| 7,111,482 | B1 * | 9/2006 | Ghiran | 72/55 |

* cited by examiner

*Primary Examiner*—David B Jones

(57) ABSTRACT

An apparatus and method for hydroshearing and hydrotrimming for a hydroforming die includes a cutting insert fixed relative to the hydroforming die. The apparatus and method also includes a disposable insert fixed relative to the hydroforming die. The apparatus and method further includes a plunger movable relative to the hydroforming die to allow fluid within a tubular member to force a wall portion of the tubular member outward against the plunger and be sheared in the hydroforming die to trim the tubular member.

13 Claims, 9 Drawing Sheets

FIG 1
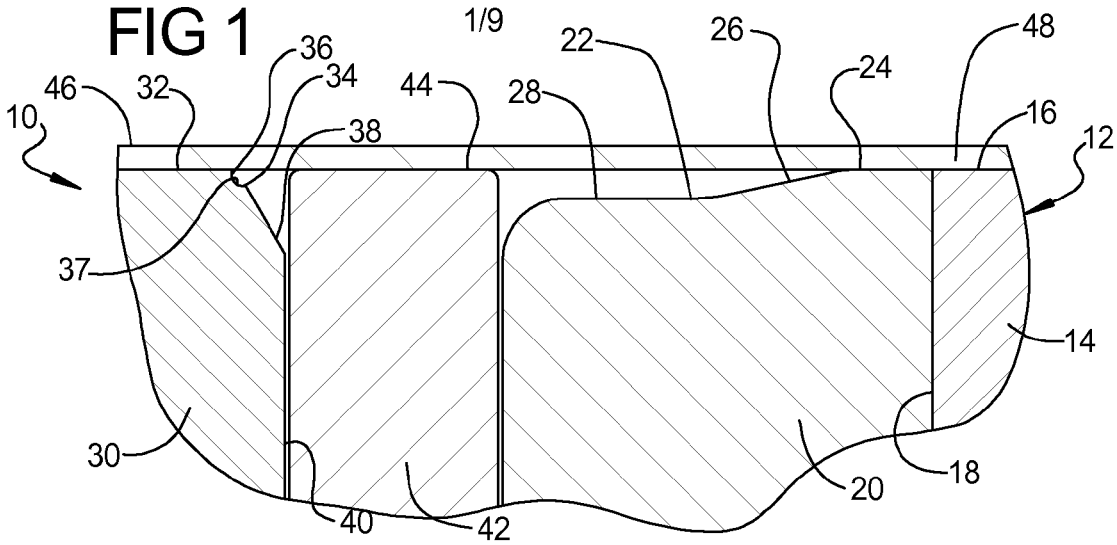
FIG 2
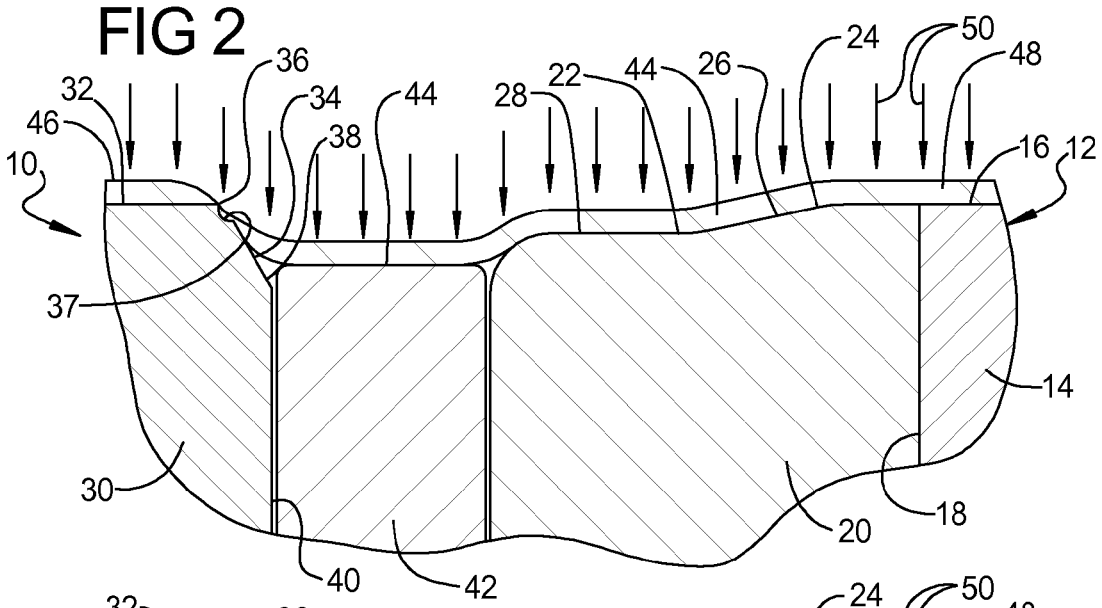
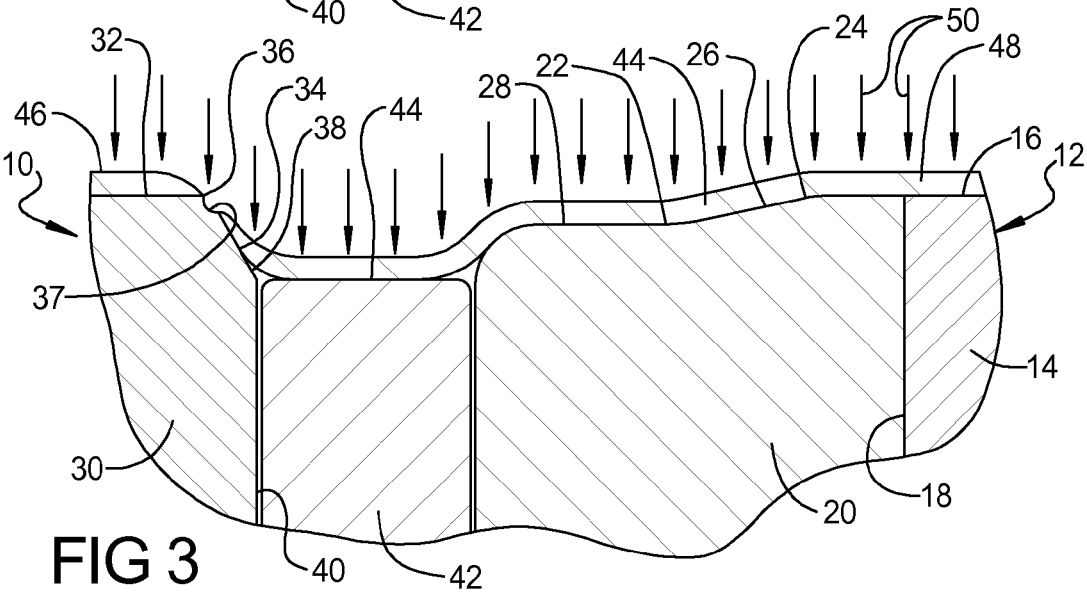
FIG 3

APPARATUS AND METHOD FOR HYDROSHEARING AND HYDROTRIMMING FOR HYDROFORMING DIE

TECHNICAL FIELD

The present invention relates generally to hydroforming and, more specifically, to an apparatus and method for hydroshearing and hydrotrimming for a hydroforming die.

BACKGROUND OF THE INVENTION

It is known to form a cross-sectional profile of a tubular member by a hydroforming process in which a fluid filled tubular member is placed within a cavity of a die and then the die is closed so that the tubular member is pinched within the die. Fluid pressure is then increased inside the tubular member to expand the tubular member outwardly against the cavity of the die to provide a tubular member having a die formed cross-sectional profile.

After preliminary shaping in the hydroforming die, the tubular member is removed from the die for further machining, processing, or fabricating. The tubular member is trimmed to have a desired length in a separate shearing operation. The length is established by laser cutting, plasma cutting, or mechanical shearing outside of the hydroforming die. These operations employ additional fixtures to accomplish the machining, processing, or fabrication. The operation also requires additional handling of the tubular member for transportation from the hydroforming die to the shearing equipment. Both of these added requirements increase the manufacturing cost and time. Unless the forming and the shearing operations are equal in length of time, more expense is incurred. If the shearing operation is slower, the tubular members must be inventoried or the hydroforming die will have down time. If the forming process is slower, the shearing apparatus will have down time.

An example of a method and apparatus for hydrotrimming and hydroshearing is disclosed in U.S. Pat. No. 5,941,112 to Ghiran et al. In this patent, a tubular member is manufactured in a hydroforming and hydroshearing apparatus. A substantially right circular cylindrical workpiece is placed in a die and pressurized to hydroform a substantially rectangular tubular product. The workpiece is presheared during a pressurization period and is fully sheared during a withdrawal of a plurality of plunger members while internal pressure is maintained. The plunger members are positioned in the die by respective power cylinders which control the withdrawal thereof.

However, it is desirable to provide a new apparatus and method for hydrotrimming and hydroshearing a tubular member during the hydroforming process. It is also desirable to provide an apparatus and method that eliminates post-forming secondary operation of mechanically shearing or laser cutting the end(s) of tubular members. It is further desirable to provide an apparatus and method having wear parts that are disposable and easy to replace. Therefore, there is a need in the art to provide a new apparatus and method for hydrotrimming and hydroshearing for a hydroforming die that meets at least one of these desires.

SUMMARY OF THE INVENTION

Accordingly, the present invention is an apparatus for hydroshearing and hydrotrimming for a hydroforming die includes a cutting insert fixed relative to the hydroforming die. The apparatus also includes a disposable insert fixed relative to the hydroforming die. The apparatus further includes a plunger movable relative to the hydroforming die to allow fluid within a tubular member to force a wall portion of the tubular member outward against the plunger and be sheared in the hydroforming die to trim the tubular member.

Additionally, the present invention is a method of hydroshearing and hydrotrimming a tubular member with a hydroforming die. The method includes the steps of providing a hydroforming die having at least one die half having a die forming cavity and a cavity extending axially therein and communicating with the die forming cavity. The method also includes the steps of disposing a cutting insert in the cavity and fixing the cutting insert relative to the die half and disposing a disposable insert in the cavity and fixing the cutting insert relative to the die half. The method includes the steps of disposing a plunger in the cavity and disposing a tubular member in the die forming cavity. The method further includes the steps of pressurizing the tubular member with hydroforming fluid, hydroshearing the tubular member, and hydrotrimming the tubular member.

One advantage of the present invention is that a new apparatus and method of hydrotrimming and hydroshearing is provided for a hydroforming die that has the ability to end trim tubular members. Another advantage of the present invention is that the apparatus and method eliminates a post-forming secondary operation of mechanically shearing or laser cutting the end(s) of tubular members, which is less expensive. Yet another advantage of the present invention is that the apparatus and method does not add additional time during hydroforming since the end is cut from the tubular member in the die during the overall forming of the tubular member. Still another advantage of the present invention is that the apparatus and method seal the tubular member, thereby conserving fluid forming pressure and synchronization of a multitude of other punches and die operations is not required. A further advantage of the present invention is that the apparatus and method allows the ends of the tubular member to be trimmed at anytime during the forming cycle as pressure is not lost during the end trimming of the tubular member. Yet a further advantage of the present invention is that the apparatus and method has wear parts that are disposable and easy to replace, providing a significant improvement in the hydroforming process. Still a further advantage of the present invention is that the apparatus and method requires fewer machines and reduces overall downtime since the forming fluid does most of the work of trimming.

Other features and advantages of the present invention will be readily appreciated, as the same becomes better understood, after reading the subsequent description taken in conjunction with the accompanying drawings.

BRIEF DESCRIPTION OF THE DRAWINGS

FIG. 1 is a fragmentary elevational view of an apparatus, according to the present invention, for hydrotrimming and hydroshearing illustrated in operational relationship with a tubular member and a hydroforming die.

FIG. 2 is a view similar to FIG. 1 illustrating a first step of a hydrotrimming and hydroshearing process.

FIG. 3 is a view similar to FIG. 1 illustrating a second step of a hydrotrimming and hydroshearing process.

DESCRIPTION OF THE PREFERRED EMBODIMENT

Figure 4:
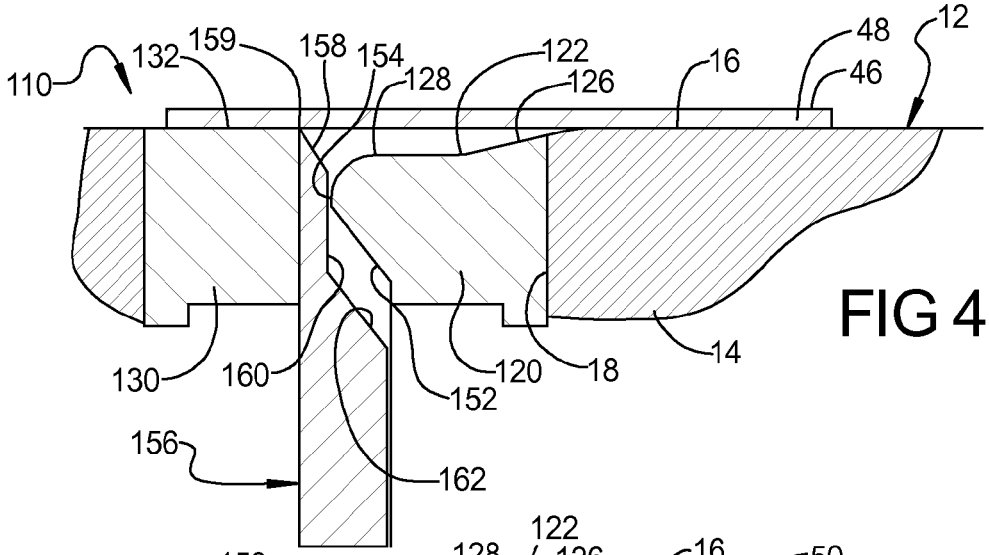
FIG. 4 is a fragmentary elevational view of another embodiment of an apparatus, according to the present invention, for hydrotrimming and hydroshearing illustrated in operational relationship with a tubular member and a hydroforming die.

Referring to the drawings and in particular FIG. 1, one embodiment of an apparatus 10, according to the present invention, is generally shown for a hydroforming die, partly shown and generally indicated at 12. The hydroforming die 12 is a die set comprised of a lower die half and an upper die half. In the embodiment illustrated, only one die half 14 is shown. The die half 14 also includes a tubular forming cavity portion 16. The die half 14 includes a cavity 18 extending axially from the tubular forming cavity portion 16. An example of such a hydroforming die 12 is disclosed in U.S. Pat. No. 5,941,112 to Ghiran et al., the disclosure of which is hereby incorporated by reference. It should be appreciated that hydroforming dies are conventional and known in the art.

The apparatus 10 also includes at least one disposable insert 20 disposed within the die half 14. The disposable insert 20 is disposed within the cavity 18 and does not move relative to the die half 14. The disposable insert 20 has an end surface 22 with a first portion 24 that is planar and flush with the surface of the die 12 for the cavity portion 16. The end surface 22 also has an inclined portion 26 extending inwardly away from the first portion 24, and a second portion 28 extending from the end of the inclined portion 26 that is planar. The disposable insert 20 is made of a rigid material such as metal.

The apparatus 10 includes at least one cutting insert 30 disposed within the die half 14. The cutting insert 30 is disposed within the cavity 18 and does not move relative to the die half 14. The cutting insert 30 is spaced from the disposable insert 20. The cutting insert 30 has an end surface 32 that is planar and flush with the surface of the die 12 for the cavity portion 16. The cutting insert 30 has a cutting surface 34 extending inwardly away from the end surface 32. The cutting surface 34 has first portion 36 extending axially from the end surface 32, a radius 37, and an inclined or second portion 38 extending axially and laterally away from the radius 37 to a side surface 40. The cutting insert 30 is made of a rigid material such as metal. It should be appreciated that the cutting surface 34 on the cutting insert 32 has an exposed edge or first portion 36 at ninety degrees (90°) straight away from a tubular member to be described for approximately the thickness thereof until a radius 37 of approximately half the thickness of the tubular member transitions into an angle of approximately thirty degrees (30°) for the second portion 38. It should also be appreciated that the profile of the cutting insert 30 is very efficient at forming a seal capable of withstanding the high pressure of the forming fluid.

The apparatus 10 also includes a plunger, generally indicated at 42, disposed within the die half 14. The plunger 42 is disposed within the cavity 18 between the disposable insert 20 and the cutting insert 30 and is movable relative to the die half 14. The plunger 42 has an end surface 44 that is planar and flush with the surface of the die 12 for the cavity portion 16. The plunger 42 is made of a rigid material such as metal. The plunger 42 is a monolithic structure being integral, unitary, and one-piece. It should be appreciated that the plunger 42 is movable relative to the die half 14. It should also be appreciated that to trim the tubular member, typically a plurality of sets of inserts 20 and 30, plunger 42, and cylinders (not shown) surround the tubular member in a manner that results in completely separating the scrap end from the finished tubular member.

In operation, a tubular member 46 (partially shown) is disposed between the lower die half and upper die half of the hydroforming die 12. The apparatus 10 is used to trim the end of the tubular member 46. As illustrated in FIG. 1, the plunger 42 is raised such that the end surface 44 engages a wall 48 of the tubular member 46. The wall 48 of the tubular member 46 is also in contact with at least a portion of the end surfaces 32 and 22 of the cutting insert 30 and disposable insert 20, respectively. It should be appreciated that, upon completion of hydroforming, the tubular member 46 is in intimate contact with a wall of the cavity portions 18 of the die 12 and the end surface 44 of the plunger 42 as illustrated in FIG. 1.

Referring to FIG. 2, hydroforming fluid 50 (indicated by arrows) in the tubular member 46 is pressurized to a forming pressure of approximately 10,000-psi. At this time, the tubular member 46 is formed and takes the shape of the cavity portions 18 by becoming in intimate contact with all surfaces of the cavity portions 18 including the end surface 44 of the plunger 42. The plunger 42 is lowered or moved away from the tubular member 46 so that the tubular member 46 is now being pushed down to make intimate contact with the cutting insert 30, plunger 42, disposable insert 20, and the die 12. With the plunger 42 slightly lower, the tubular member 46 is stretched over an edge between the radius 37 and the second portion 38 of the cutting insert 30. As illustrated in FIG. 3, the plunger 42 has moved down or further away from the tubular member 46, causing the forming pressure to continue stretching the tubular member 46 over the edge of the cutting insert until the tubular member 46 has been cut. It should be appreciated that the trimmed edges are very smoothly cut, free of burrs. It should also be appreciated that even after the tubular member 46 has been trimmed, the angled face or second portion 38 of the cutting insert 30 supports the trimmed end and continues to hold the high forming fluid pressure. It should further be appreciated that, since this apparatus 10 preserves the high forming fluid pressure, other operations that require high pressure can be accomplished without complicated timing or synchronization methods.

Referring to FIG. 4, another embodiment, according to the present invention, of the apparatus 10 is shown. Like parts of the apparatus 10 have like reference numerals increased by one hundred (100). In this embodiment, the apparatus 110 includes at least one disposable insert 120 disposed within the die half 14 of the die 12. The disposable insert 120 is disposed within the cavity 18 and does not move relative to the die half 14. The disposable insert 120 has an end surface 122 disposed below the surface of the die 12 for the cavity portion 16. The end surface 122 has an inclined portion 126 and a planar portion 128 extending from the end of the inclined portion 126. The disposable insert 120 also has a recessed inclined portion 152 extending inwardly away from a side 154 thereof that is generally planar. The disposable insert 120 is made of a rigid material such as metal.

The apparatus 110 includes at least one cutting insert 130 disposed within the die half 14. The cutting insert 130 is disposed within the cavity 18 and does not move relative to the die half 14. The cutting insert 130 is spaced from the disposable insert 120. The cutting insert 130 has an end surface 132 that is planar and flush with the surface of the die 12 for the cavity portion 16. The cutting insert 130 is made of a rigid material such as metal.

The apparatus 110 also includes a cutting blade, generally indicated at 156, disposed within the die half 14. The cutting blade 156 is disposed within the cavity 18 between the cutting insert 130 and the disposable insert 120 and is movable relative to the die half 14. The cutting blade 156 has a cutting surface 158 extending inwardly from an end or edge 159 thereof. The cutting surface 158 is inclined axially and laterally away from the end thereof. The cutting blade 156 has a side surface 160 extending axially and an inclined surface 162 extending axially and laterally away from the side surface 160 to mate with the inclined surface 152 of the disposable insert 120 that acts as a stop. The cutting blade 156 is made of a rigid material such as metal. The cutting blade 156 is a monolithic structure being integral, unitary, and one-piece. It should be appreciated that the cutting blade 156 is movable relative to the die half 14. It should also be appreciated that to trim the tubular member 46, typically a plurality of sets of inserts 120, 130, blades 156, and cylinders (not shown) surround the tubular member 46 in a manner that results in completely separating the scrap end from the finished tubular member.

In operation, the tubular member 46 is disposed between the lower die half and upper die half of the hydroforming die 12. The apparatus 110 is used to trim the end of the tubular member 46. As illustrated in FIG. 4, the cutting blade 156 is raised such that the end 159 engages the wall 48 of the tubular member 46. The wall 48 of the tubular member 46 is also in contact with the end surface 132 of the cutting insert 130 and surface of the cavity portion 16.

Figure 5:
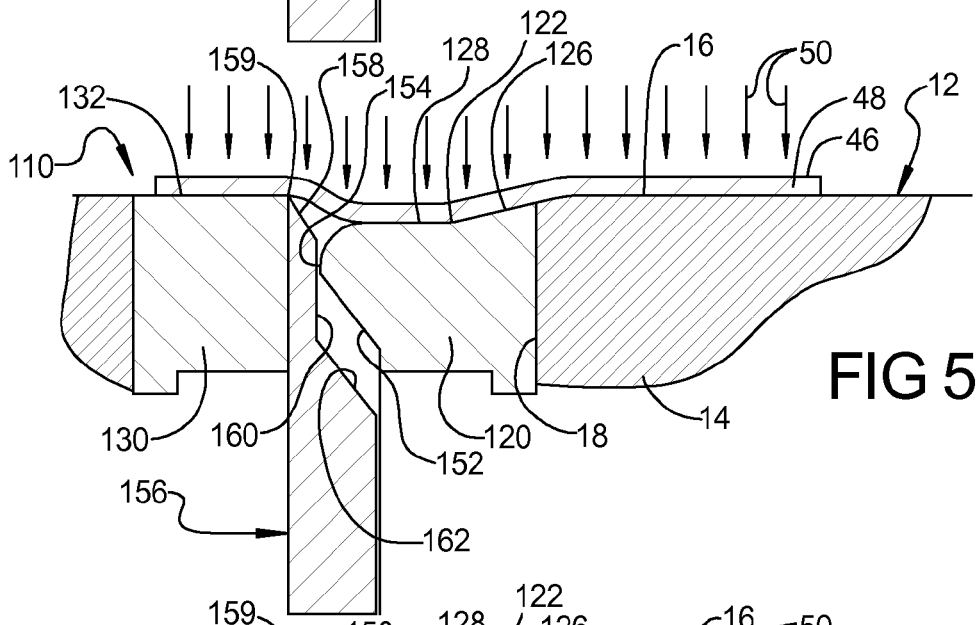
FIG. 5 is a view similar to FIG. 4 illustrating a first step of a hydrotrimming and hydroshearing process.
Figure 6:
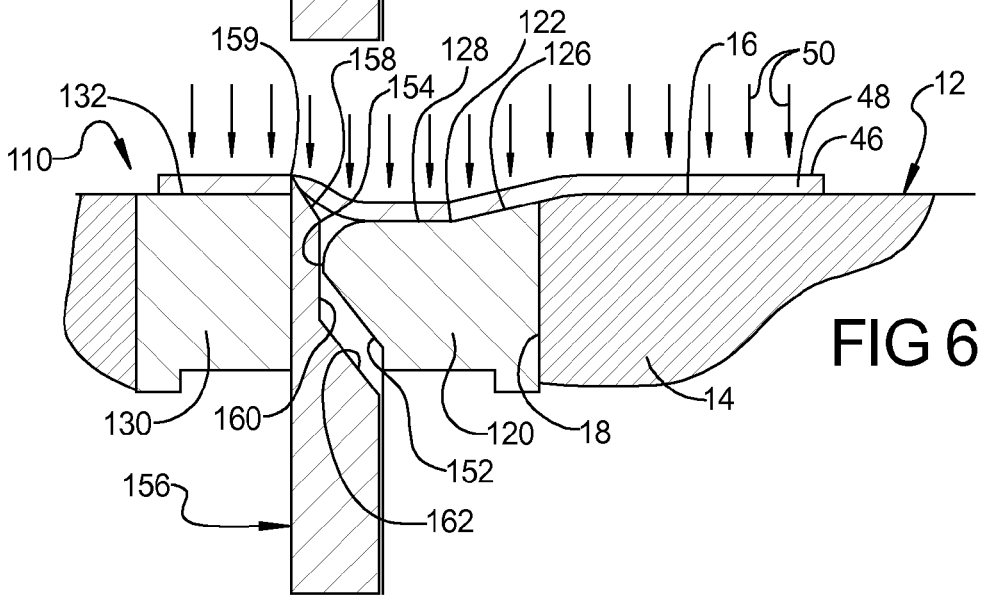
FIG. 6 is a view similar to FIG. 4 illustrating a second step of a hydrotrimming and hydroshearing process.

Referring to FIG. 5, the hydroforming fluid 50 (indicated by arrows) in the tubular member 46 is pressurized to a forming pressure of approximately 10,000-psi. At this time, the tubular member 46 is formed and takes the shape of the cavity portions 18 by becoming in intimate contact with all surfaces of the cavity portions 18 including the end surface 132 of the cutting insert 130. The forming fluid pressure pushes the tubular member 46 down to make intimate contact with the cutting insert 130, disposable insert 120, and the die 12. The tubular member 46 is stretched over the edge of the cutting insert 130 and becomes thin. As illustrated in FIG. 6, the cutting blade 156 is moved up or into the tubular member 46 by a cylinder (not shown). As the cutting blade 156 moves into the tubular member 46, the forming pressure begins stretching the wall 48 over the moving cutting blade 156, where the wall 48 continues to thin until the tubular member 46 is trimmed. It should be appreciated that the trimmed edges are smoothly cut, free of burrs. It should also be appreciated that even after the tubular member 46 has been trimmed, the angle of the cutting blade 156 supports the tubular member and seals without a loss of forming fluid pressure. It should further be appreciated that, since this apparatus 110 preserves the high forming fluid pressure, other operations that require high pressure can be accomplished without complicated timing or synchronization methods.

Figure 7:
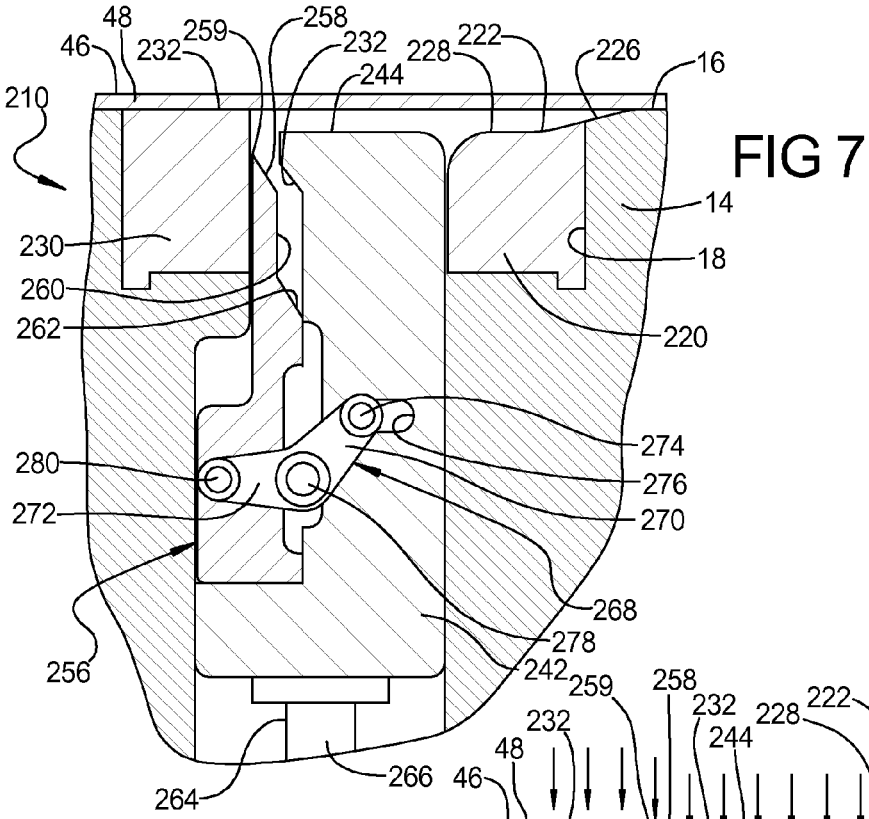
FIG. 7 is a fragmentary elevational view of yet another embodiment of an apparatus, according to the present invention, for hydrotrimming and hydroshearing illustrated in operational relationship with a tubular member and a hydroforming die.

Referring to FIG. 7, yet another embodiment, according to the present invention, of the apparatus 10 is shown. Like parts of the apparatus 10 have like reference numerals increased by two hundred (200). In this embodiment, the apparatus 210 includes at least one disposable insert 220 disposed within the die half 14. The disposable insert 220 is disposed within the cavity 18 and does not move relative to the die half 14. The disposable insert 220 has an end surface 222 that is disposed below the surface of the die 12 for the cavity portion 16. The end surface 222 has an inclined portion 226 and a planar portion 228 extending from the end of the inclined portion 226. The disposable insert 220 is made of a rigid material such as metal.

The apparatus 210 includes at least one cutting insert 230 disposed within the die half 14. The cutting insert 230 is disposed within the cavity 18 and does not move relative to the die half 14. The cutting insert 230 is spaced from the disposable insert 230. The cutting insert 230 has an end surface 232 that is planar and flush with the surface of the die 12 for the cavity portion 16. The cutting insert 230 is made of a rigid material such as metal.

The apparatus 210 also includes a plunger, generally indicated at 242, disposed within the die half 14. The plunger 242 is disposed within the cavity 18 between the disposable insert 220 and the cutting insert 230 and is movable relative to the die half 14. The plunger 242 has an end surface 244 that is planar and is disposed below the surface of the die 12 for the cavity portion 16. The plunger 242 is made of a rigid material such as metal. The plunger 242 is a monolithic structure being integral, unitary, and one-piece. It should be appreciated that the plunger 242 is movable relative to the die half 14 by a cylinder 264 (partially shown) connected thereto.

The apparatus 210 also includes a cutting blade, generally indicated at 256, disposed within the die half 14. The cutting blade 256 is disposed within the cavity 18 between the cutting insert 230 and the plunger 242 and is movable relative to the die half 14. The cutting blade 256 has a cutting surface 258 extending inwardly away from an end or edge 259 thereof. The cutting surface 258 is inclined axially and laterally away from the edge 259 thereof. The cutting blade 256 has a side surface 260 extending axially and an inclined surface 262 extending axially away from the side surface to mate with an inclined surface 263 of the plunger 242 that acts as a stop. The cutting blade 256 is made of a rigid material such as metal. The cutting blade 256 is a monolithic structure being integral, unitary, and one-piece. It should be appreciated that the cutting blade 256 is movable relative to the die half 14. It should be appreciated that to trim the tubular member 46, typically a plurality of sets of inserts 220, 230, blades 256, plungers 242, and cylinders surround the tubular member 46 in a manner that results in completely separating the scrap end from the finished tubular member.

The apparatus 210 includes a single hydraulic cylinder 264 to move both the blade 256 and the plunger 242. The hydraulic cylinder 264 has a movable rod 266 connected to an end of the plunger 242. It should be appreciated that the hydraulic cylinder 264 is conventional and known in the art.

The apparatus 210 further includes a link mechanism, generally indicated at 268, connecting the blade 256 to the plunger 242 and synchronizes the timing and motion of the blade 256. The link mechanism 268 includes at least one first linkage 270 extending axially and at least one second linkage 272 extending axially. The first linkage 270 is connected to the plunger 242 by a suitable mechanism such as a pin 274 disposed in a slot 276 thereof. The first linkage 270 is connected to the second linkage 272 by a suitable mechanism such as a pin 278. The second linkage 272 is connected to the blade 256 by a suitable mechanism such as a pin 280 disposed in a slot 282 thereof. It should also be appreciated that the center point of the linkage is fixed and independent from the cutting blade 256 and plunger 242. It should also be appreciated that the linkage connects the cutting blade 256 to the plunger 242, eliminating a separate hydraulic cylinder for the cutting blade 256.

In operation, the tubular member 46 is disposed between the lower die half and upper die half of the hydroforming die 12. The apparatus 210 is used to trim the end of the tubular member 46. As illustrated in FIG. 7, the plunger 242 is raised such that the end surface 244 is spaced from or below the wall 48 of the tubular member 46. The wall 48 of the tubular member 46 is in contact with the end surface 232 of the cutting insert 230 and surface of the cavity portions 18.

Figure 8:
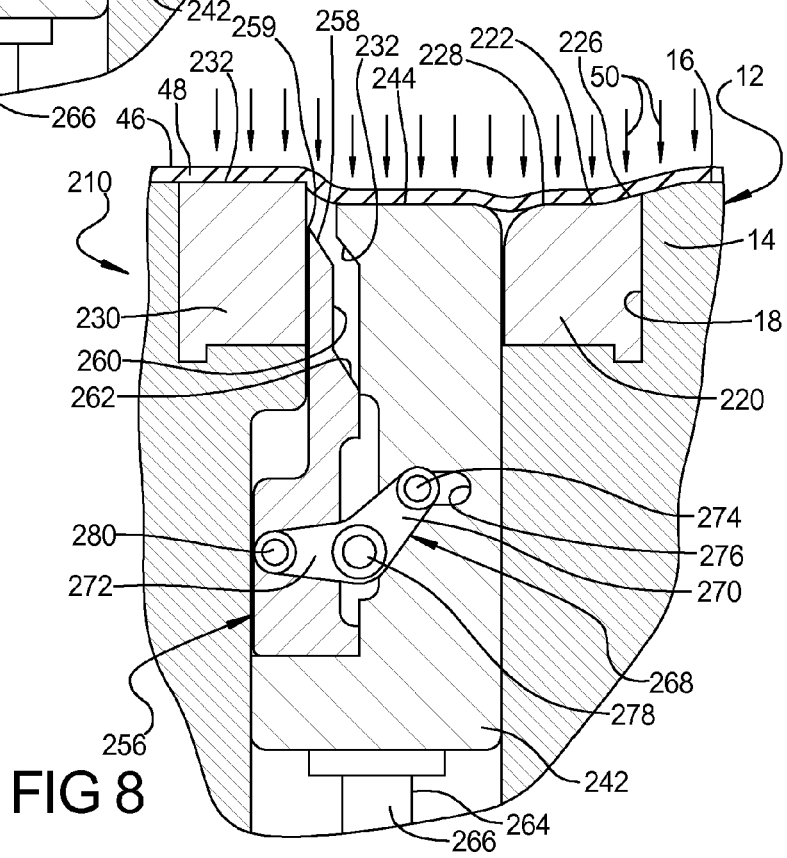
FIG. 8 is a view similar to FIG. 7 illustrating a first step of a hydrotrimming and hydroshearing process.

Referring to FIG. 8, the hydroforming fluid 50 (indicated by arrows) in the tubular member 46 is pressurized to a forming pressure of approximately 10,000-psi. At this time, the tubular member 46 is formed and takes the shape of the cavity portions 18 by becoming in intimate contact with all surfaces of the cavity portions 18 including an end surface 232 of the cutting insert 230. The forming fluid pressure pushes tubular member 46 down to make intimate contact with the cutting insert 230, disposable insert 220, and the die 12. The tubular member 46 is stretched over the edge of the cutting insert 230 and becomes thin.

Figure 9:
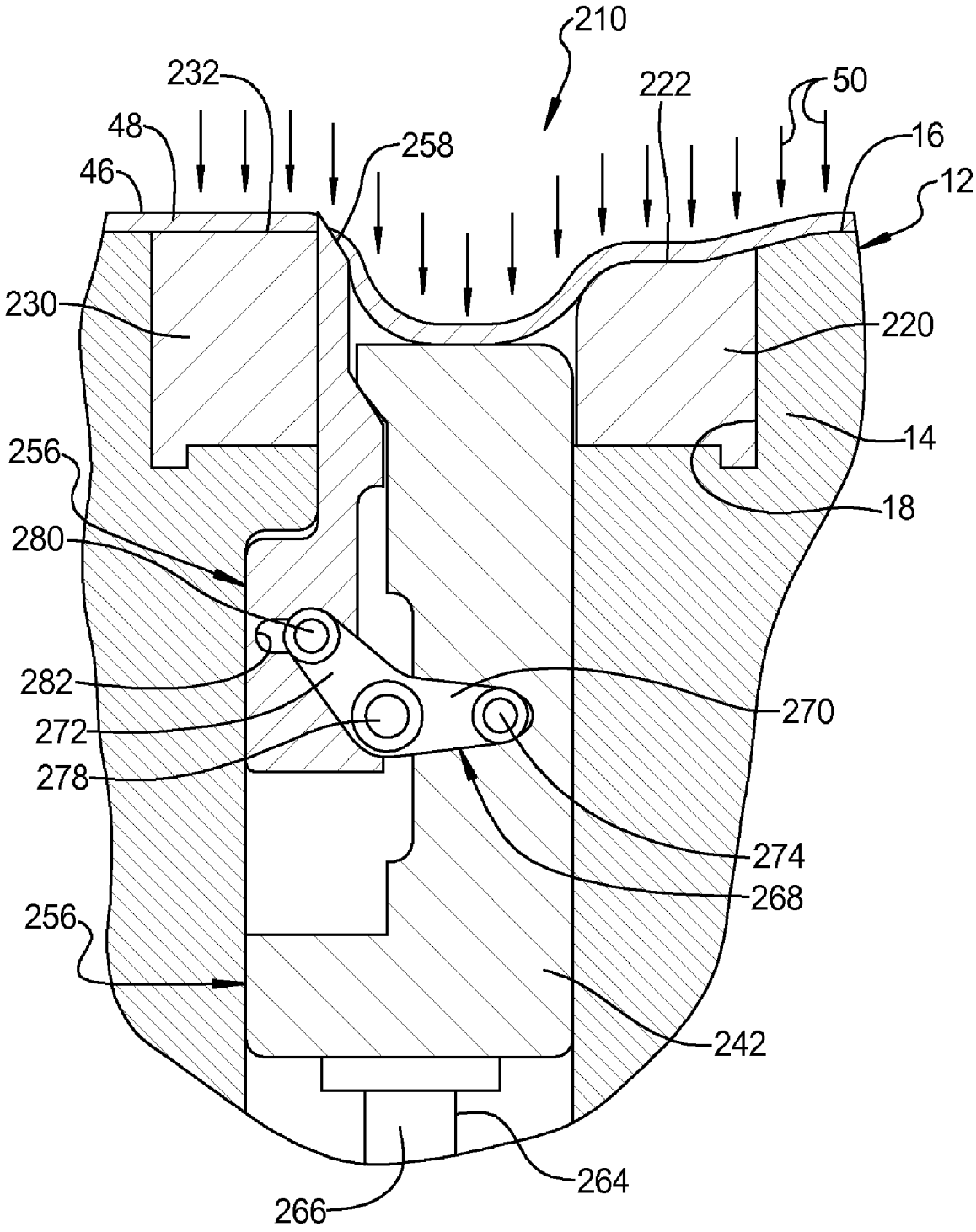
FIG. 9 is a view similar to FIG. 8 illustrating a second step of a hydrotrimming and hydroshearing process.

As illustrated in FIG. 8, the plunger 242 starts to move backward, the linkages 270 and 272 will follow the same movement. During the backward movement of the plunger 242, the cutting blade 256 is raised by the linkage mechanism 268 as the tubular member 46 continues to stretch over the cutting insert 230, getting thinner until the cutting blade 256 cuts the remaining portion of the wall 48 of the tubular member 46 as it moves upward or into the die 12 to complete the shearing of the tubular member 46 to stay in intimate contact with the surface of the plunger 242 and follow the movement of the plunger 242 as illustrated in FIG. 9. It should be appreciated that the trimmed edges are smoothly cut, free of burrs. It should also be appreciated that the tubular member 46 continues to hold the high pressure forming fluid even after the tubular member 46 is sheared since the cutting blade 256 supports the sheared edge and forms a seal. It should further be appreciated that, since this apparatus 210 preserves the high forming fluid pressure, other operations that require high pressure can be accomplished without complicated timing or synchronization methods.

Figure 10:
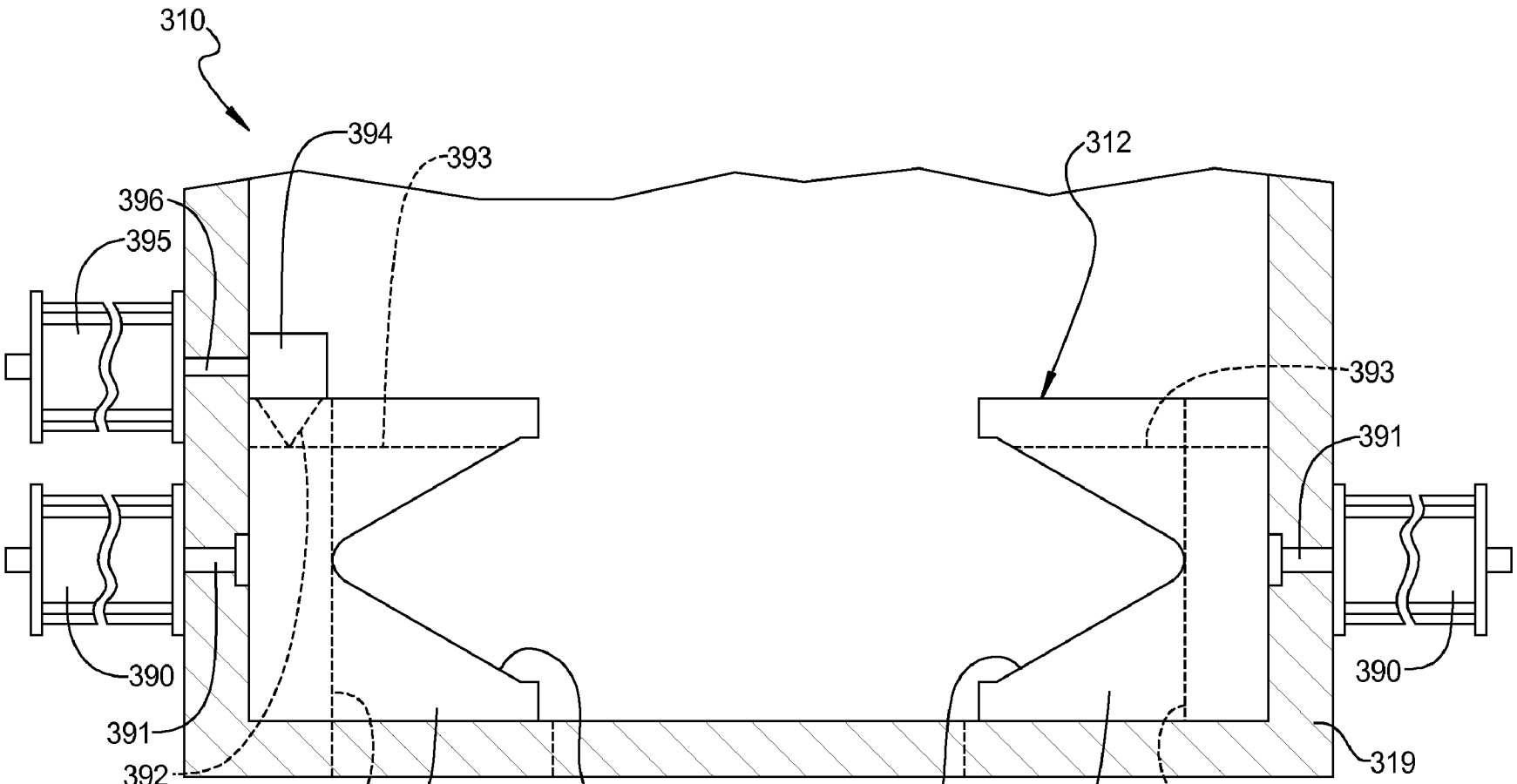
FIG. 10 is a fragmentary elevational view of still another embodiment of an apparatus, according to the present invention, for hydrotrimming and hydroshearing illustrating a first step of a hydrotrimming and hydroshearing process.
Figure 11:
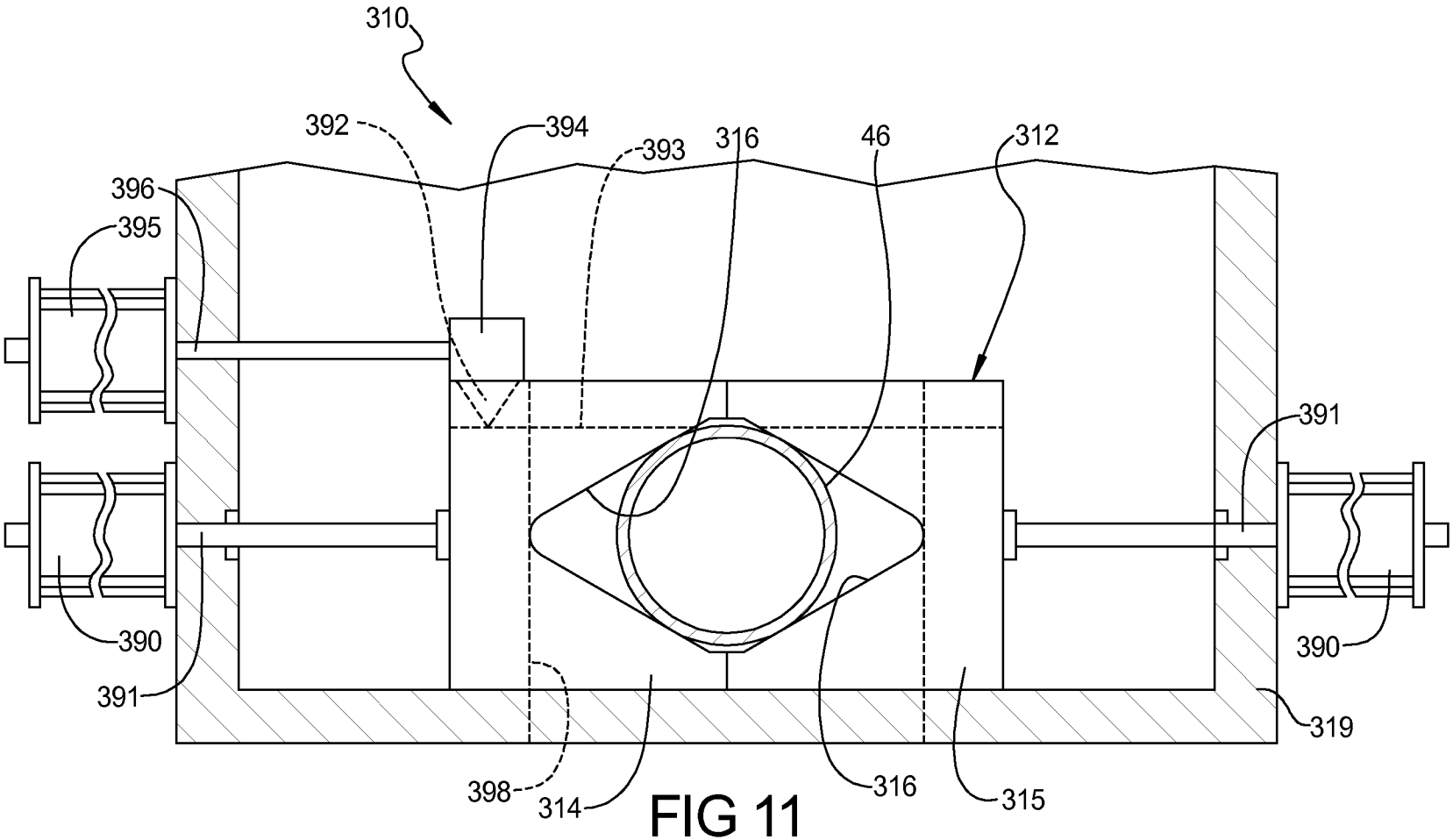
FIG. 11 is a view similar to FIG. 10 illustrating a second step of a hydrotrimming and hydroshearing process.

Referring to FIGS. 10 through 14, still another embodiment, according to the present invention, of the apparatus 10 is shown. Like parts of the apparatus 10 have like reference numerals increased by three hundred (300). In this embodiment, the apparatus 310 includes a die 312 in which a final product such as a tube is hydroformed and hydrosheared. The die 312 has a first die half 314 and a second die half 315 which can be separated to insert a workpiece or tubular member 46 as seen in FIG. 11. The tubular member 46 has a generally oval or circular cross-section. The particular tubular member 46 is shown with an oval cross-section. The first die half 314 and second die half 315 form a cavity 316. It should be appreciated that the die 312 is supported by a support surface such as a housing 319.

The apparatus 310 also includes fluid cylinders 390 having rods 391 to reciprocally power the first die half 314 and second die half 315. The cylinders 390 may be actuated by a hydraulic or pneumatic pressure source (not shown). The cylinders 390 are connected to the housing 319 by a suitable mechanism such as fasteners (not shown) and the rods 391 extend through the housing and are connected to the first die half 314 and second die half 315 by a suitable mechanism such as fasteners (not shown).

The apparatus 310 includes a first blade 392 to nick or score the tubular member 46. The first blade 392 is generally "V" shaped and extends into a slot 393 extending along the first die half 314 and second die half 315. The apparatus 310 also includes a blade support 394 connected to the first blade 392 to support the first blade 392 along the first die half 314 and second die half 315. The apparatus 310 includes a fluid cylinder 395 having a rod 396 to reciprocally power the first blade 392. The cylinder 395 may be actuated by a hydraulic or pneumatic pressure source (not shown). The cylinder 395 is connected to the housing 319 by a suitable mechanism such as fasteners (not shown) and the rod 396 extends through the housing 319 and is connected to the blade support 394 by a suitable mechanism such as fasteners (not shown).

Figure 12:
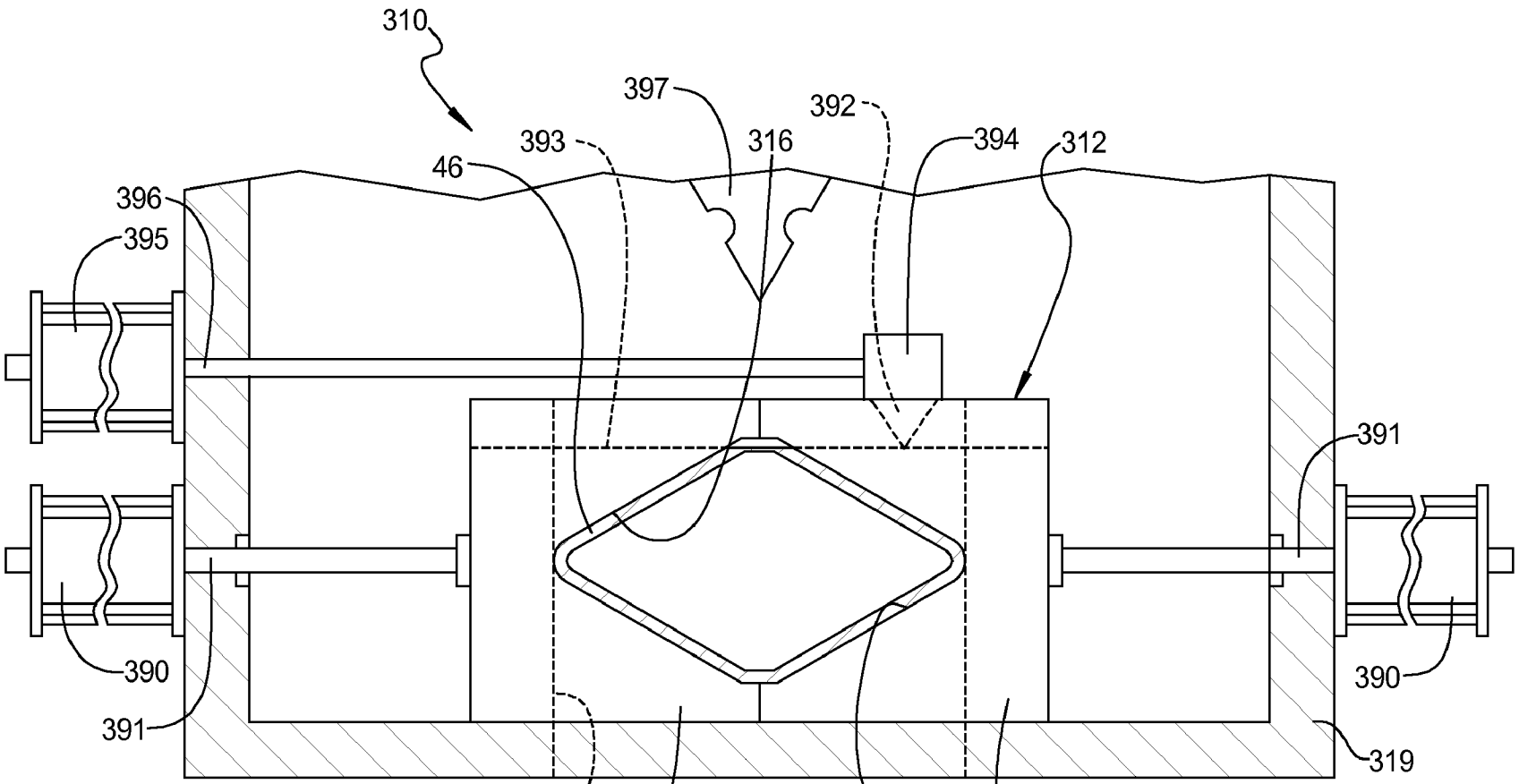
FIG. 12 is a view similar to FIG. 10 illustrating a third step of a hydrotrimming and hydroshearing process.
Figure 13:
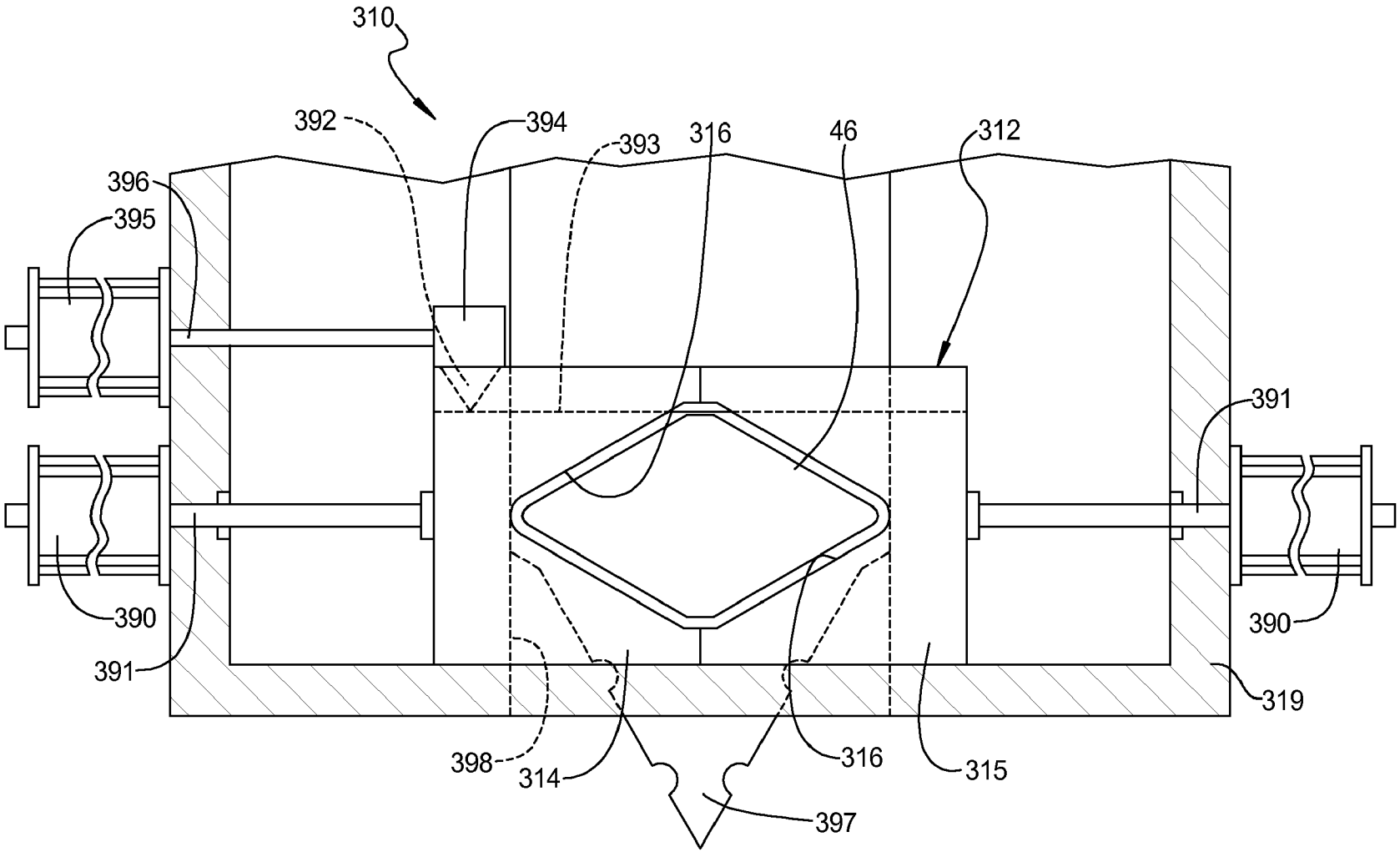
FIG. 13 is a view similar to FIG. 10 illustrating a fourth step of a hydrotrimming and hydroshearing process.
Figure 14:
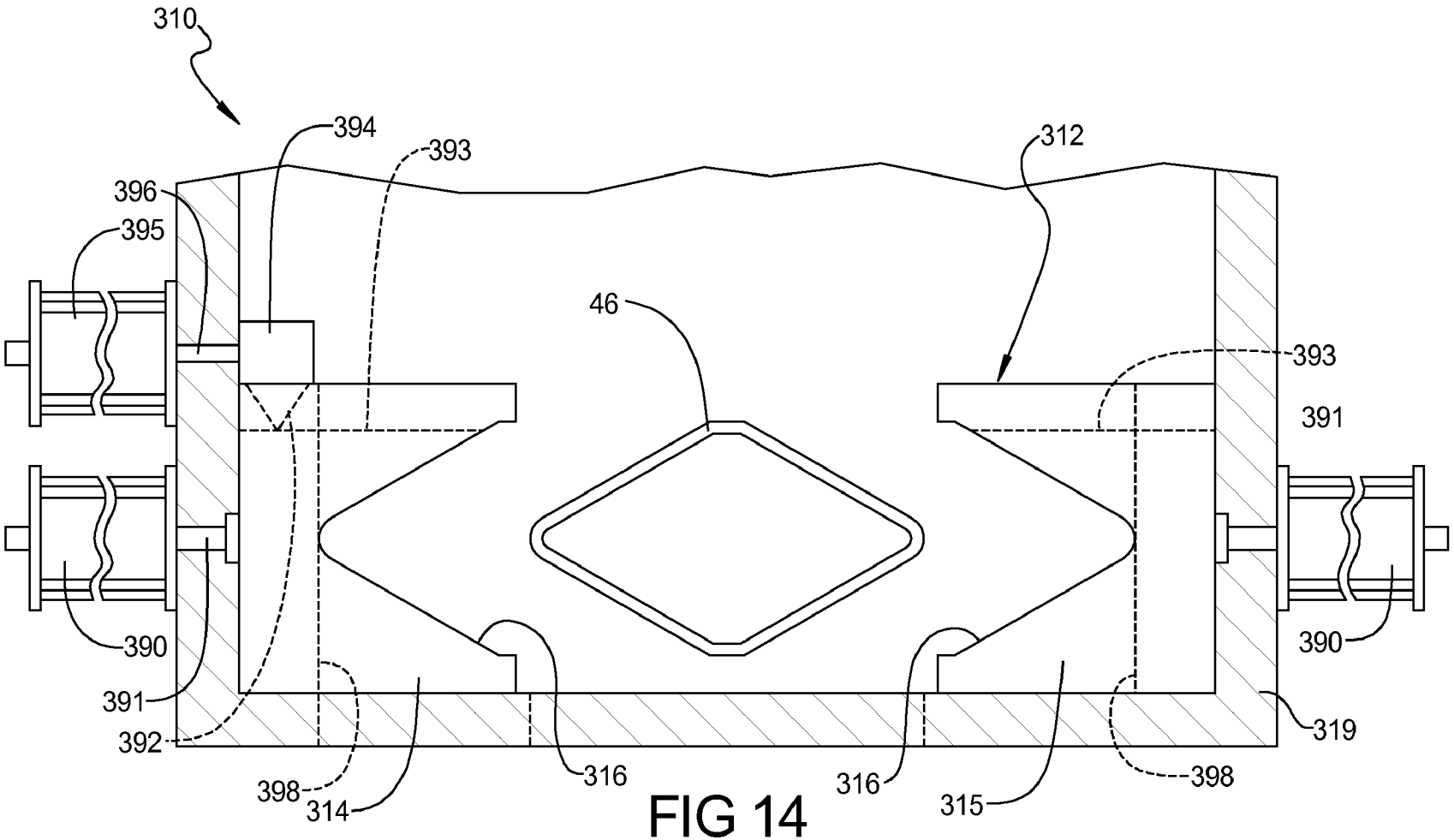
FIG. 14 is a view similar to FIG. 10 illustrating a fifth step of a hydrotrimming and hydroshearing process.

As illustrated in FIGS. 12 and 13, the apparatus 310 includes a second blade 397 to shear the tubular member 46. The second blade 397 is generally "V" shaped. The apparatus 310 includes a fluid cylinder (not shown) having a rod (not shown) to reciprocally power the second blade 397. The cylinder may be actuated by a hydraulic or pneumatic pressure source (not shown). It should be appreciated that the second blade 397 is moved to extend into the slot 393 of the first die half 314 and second die half 315.

In operation, the first die half 314 and the second die half 15 are open as illustrated in FIG. 10. The tubular member 46 is disposed in the cavity 316 between the first die half 314 and the second die half 315 and the die halves 314 and 315 are closed as illustrated in FIG. 11. The ends of the tubular member 46 are sealed and the interior of the tubular member 46 is pressurized in a well-known manner to hydroform the tubular member 46 to the shape of the cavity 316 as illustrated in FIG. 12. It should be appreciated that hydroforming of tubular components is a well-known process.

Referring to FIG. 12, in this method, the first blade 392 is moved by the cylinder 395, rod 396, and blade support 394 past the tubular member 46, cutting a small groove or nick in the tubular member 46. After the first blade 392 has nicked the tubular member 46, the second blade 397 from a different direction enters the weakened, nicked tubular member 46 and finishes the shearing action as illustrated in FIG. 13. The die halves 314 and 315 are opened and the sheared tubular member 46 is then removed. It should be appreciated that the length of the tubular member 46 is determined in the hydroshearing process. It should also be appreciated that the offal (not shown) can be recycled as desired.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. An apparatus for hydroshearing and hydrotrimming for a hydroforming die comprising:

a cutting insert fixed relative to the hydroforming die;

a disposable insert fixed relative to the hydroforming die;

a plunger movable relative to the hydroforming die to allow fluid within a tubular member to force a wall portion of the tubular member outward against said plunger and be sheared in the hydroforming die to trim the tubular member; and a cutting blade having a cutting edge and being movable relative to the hydroforming die.

2. An apparatus as set forth in claim 1 wherein said cutting insert has an end surface that is generally planar to contact the tubular member.

3. An apparatus as set forth in claim 1 wherein said disposable insert has an end surface with at least a portion spaced from the tubular member.

4. An apparatus as set forth in claim 1 wherein said plunger has an end surface that is generally planar.

5. An apparatus as set forth in claim 1 wherein said cutting insert has a cutting edge.

6. An apparatus as set forth in claim 1 including a link mechanism to connect said cutting blade to said plunger.

7. An apparatus as set forth in claim 6 wherein said link mechanism comprises a plurality of first linkages having one end connected to said plunger and a plurality of second linkages having one end connected to said first linkages and another end connected to said cutting blade.

8. An apparatus as set forth in claim 7 including a plurality of pins to connect said linkages together at ends thereof.

9. An apparatus as forth in claim 1 wherein said cutting blade is disposed between said cutting insert and said plunger, and said plunger is disposed between said cutting blade and said disposable insert.

10. An apparatus for hydroshearing and hydrotrimming comprising: a hydroforming die having at least one die half having a die forming cavity for receiving the tubular member and a cavity extending axially therein and communicating with said die forming cavity;

a cutting insert disposed in said cavity and fixed relative to said die half, said cutting insert having an end surface that is generally planar to contact the tubular member;

a disposable insert disposed in said cavity and fixed relative to said die half, said disposable insert having an end surface with at least a portion spaced from the tubular member; and a plunger disposed in said cavity and movable relative to said die half, said plunger being a cutting blade with a cutting edge to allow fluid within a tubular member to force a wall portion of the tubular member outward against said plunger and be sheared in said hydroforming die to trim the tubular member.

11. An apparatus for hydroshearing and hydrotrimming comprising:

a hydroforming die having at least one die half having a die forming cavity for receiving the tubular member and a cavity extending axially therein and communicating with said die forming cavity;

a cutting insert disposed in said cavity and fixed relative to said die half, said cutting insert having an end surface that is generally planar to contact the tubular member;

a disposable insert disposed in said cavity and fixed relative to said die half, said disposable insert having an end surface with at least a portion spaced from the tubular member;

a cutting blade movable relative to the hydroforming die;

a plunger disposed in said cavity and movable relative to said die half; and a link mechanism to connect said cutting blade to said plunger to allow fluid within a tubular member to force a wall portion of the tubular member outward against said plunger and be sheared by said cutting blade in said hydroforming die to trim the tubular member.

12. An apparatus for hydroshearing and hydrotrimming a tubular member comprising:

a hydroforming die having at least one die half having a die forming cavity for receiving the tubular member and a cavity extending axially therein and communicating with said die forming cavity;

a first blade movable relative to said die forming cavity to cut a groove in the tubular member; and a second blade movable relative to said die forming cavity in direction different from said first blade to shear the tubular member in said hydroforming die to trim the tubular member.

13. A method of hydroshearing and hydrotrimming a tubular member with a hydroforming die, said method comprising the steps of:

providing a hydroforming die having at least one die half having a die forming cavity and a cavity extending axially therein and communicating with the die forming cavity;

moving a first blade relative to the die forming cavity to cut a groove in the tubular member; and moving a second blade relative to the die forming cavity in direction different from the first blade to shear the tubular member in the hydroforming die to trim the tubular member.

* * * * *